United States Patent [19]

Iwata

[11] Patent Number: 4,718,395

[45] Date of Patent: Jan. 12, 1988

[54] IGNITION CONTROL SYSTEM FOR INTERNAL COMBUSTION ENGINE

[75] Inventor: Toshio Iwata, Hyogo, Japan

[73] Assignee: Mitsubishi Denki Kabushiki Kaisha, Tokyo, Japan

[21] Appl. No.: 7,241

[22] Filed: Jan. 27, 1987

[30] Foreign Application Priority Data

Jan. 30, 1986 [JP] Japan ..... 61-20625

[51] Int. Cl.[4] ..... F02P 11/00

[52] U.S. Cl. ..... 123/615; 123/414; 123/630

[58] Field of Search ..... 123/414, 479, 615, 619, 123/630, 643

[56] References Cited

U.S. PATENT DOCUMENTS

| | | | |
|---|---|---|---|
| 4,109,630 | 8/1978 | Richeson, Jr. et al. | 123/615 |
| 4,531,490 | 7/1985 | Kishi et al. | 123/479 X |
| 4,561,411 | 12/1985 | Masuno | 123/615 |
| 4,597,373 | 7/1986 | Andreasson | 123/630 |
| 4,658,786 | 4/1987 | Foss et al. | 123/630 X |

FOREIGN PATENT DOCUMENTS

| | | | |
|---|---|---|---|
| 0198366 | 12/1982 | Japan | 123/630 |
| 0222977 | 12/1983 | Japan | 123/630 |

*Primary Examiner*—Willis R. Wolfe

*Attorney, Agent, or Firm*—Sughrue, Mion, Zinn, Macpeak and Seas

[57] ABSTRACT

An ignition control system for an internal combustion engine has an oscillator for generating a clock signal, ignition timing signal generator means for generating an ignition timing signal synchronized with the ignition timing of the engine, a defect detector for detecting the defect of the oscillator, a control circuit for calculating the energizing timing of an ignition coil from the ignition timing signal when the oscillator is normal, and a switching circuit for disconnecting the output of the control circuit when the oscillator is defective to lead the ignition timing signal to an igniter, thereby switching the switching circuit to the output side of the control circuit by the output of the defect detector when the oscillator is normal to calculate the energizing timing of the ignition coil by the control circuit from the ignition timing signal to lead it to the igniter, and thereby switching the switching circuit by the defect detector when the oscillator is defective to lead the ignition timing signal directly to the igniter.

5 Claims, 4 Drawing Figures

IGNITION CONTROL SYSTEM FOR INTERNAL COMBUSTION ENGINE

BACKGROUND OF THE INVENTION

The present invention relates to an ignition control system for an internal combustion engine adapted to judge that the ignition control system is defective if a clock pulse is not outputted from an oscillator.

An induction discharge type igniter used for an internal combustion engine has incorporated an ignition control system for controlling the energizing timing of an ignition coil due to the development of recent electronic circuit technique.

An ignition control system for calculating the energizing timing of an ignition coil according to a clock pulse outputted from an oscillator by a digital circuit has been proposed as disclosed, for example, in Japanese Patent Laid-open No. 40141/1978.

However, if the clock pulse is not outputted from the oscillator due to certain cause in this ignition control system, the calculation of the energizing time is paused to stop the intermittently interrupting operation of the ignition coil. As a result, there arises a problem that an internal combustion engine is not ignited to stop rotating of the engine.

SUMMARY OF THE INVENTION

An object of this invention is, therefore, to provide an ignition control system for an internal combustion engine capable of eliminating the above-mentioned disadvantages in the prior art and preventing the engine from stopping of rotation if a clock pulse is not outputted from an oscillator and readily judging a defect.

In order to achieve the above and other objects, an ignition control system for an internal combustion engine according to the present invention comprises:

signal generating means for generating an ignition timing signal synchronized with the rotation of the engine;

an oscillator for generating a clock pulse;

control means for calculating the energizing time of an ignition coil upon reception of the clock pulse from the oscillator and the ignition timing signal from the signal generating means;

defect detector means for detecting the presence or absence of a defect of the clock pulse of the oscillator; and switching means controlled to be switched by the defect detector means for leading the output of the control means to an igniter when the clock pulse is normally outputted from the oscillator and leading the output of the signal generating means to the igniter when the clock pulse is abnormally outputted from the oscillator.

BRIEF DESCRIPTION OF THE DRAWINGS

The above objects and features of the present invention will be more clearly understood by the following detailed description of preferred embodiments in conjunction with the accompanying drawings in which.

Figure 1:
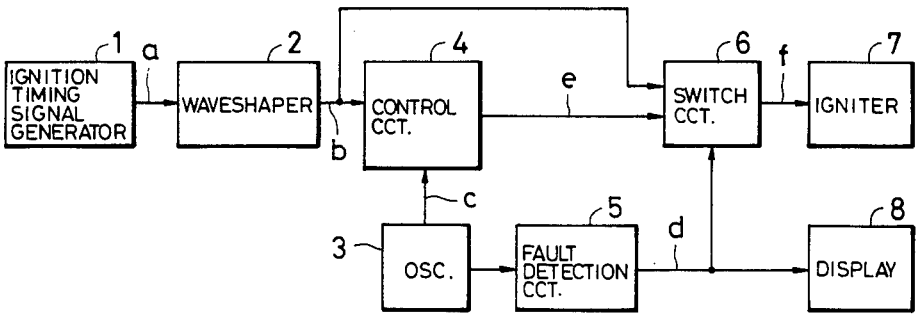
FIG. 1 is a block diagram showing an embodiment of an ignition control system for an internal combustion engine according to the present invention.
Figure 3:
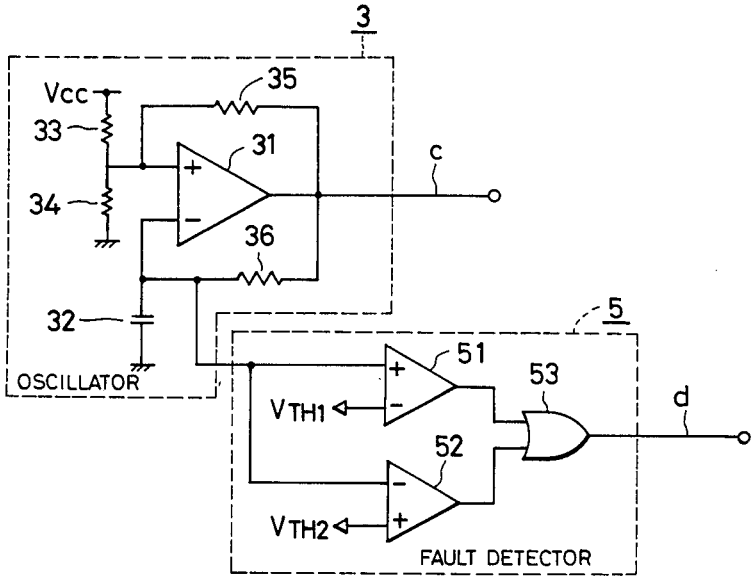

FIGS. *2a–g* show a time chart of signals of sections of the ignition control system of the engine in FIG. 1 for describing the operation of the control system;

FIG. 3 is a circuit diagram of an oscillator and a defect detector circuit in the ignition control system of the engine in FIG. 1; and FIGS. *4a–d* show a time chart for describing the operation of the oscillator and the defect detector circuit in FIG. 3.

DESCRIPTION OF THE PREFERRED EMBODIMENTS

Referring to FIG. 1, an embodiment of the invention comprises an ignition timing signal generator 1 for generating a signal synchronized with the ignition timing of an internal combustion engine, such as a signal generator contained in a distributor, not shown.

A waveform shaper circuit 2 is connected to the output of the generator 1 to shape the output signal of the generator 1 in a rectangular shape.

The output of the waveform shaper 2 and the output of an oscillator 3 are applied to a control circuit 4. The oscillator 3 generates a clock pulse, and the control circuit 4 calculates the energizing time of an ignition coil.

The output of the oscillator 3 is inputted to a defect detector circuit 5, thereby to detect the presence or absence of the output of the clock pulse of the oscillator 3.

A switching circuit 6 switched between the output signal of the waveform shaper 2 and the output signal of the control circuit 4 to lead the output signal to an igniter 7. The igniter 7 intermittently energizes and interrupts the ignition coil according to the output signal of the switching circuit 6. Numeral 8 designates a display circuit for displaying a defect in accordance with the output of the defect detector 5.

Figure 2:
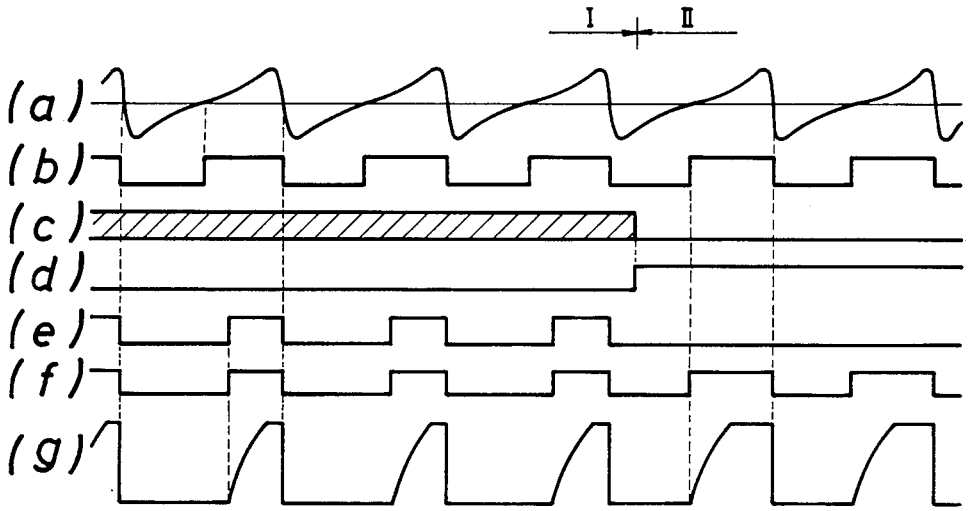

The operation of the embodiment of the ignition control system thus constructed will be described in detail with reference to the time charts of FIGS. 2(*a*) to 2(*f*), illustrating the waveforms at points a to f in FIG. 1. FIG. 2(*a*) shows the output signal waveform of the ignition timing signal generator 1, FIG. 2(*b*) shows a rectangular wave signal shaped by the waveform shaper 2, and the falling edge time of the rectangular wave is used as an ignition timing.

FIG. 2(*c*) shows a clock pulse outputted from the oscillator 3, and since the frequency of the pulse is high, the pulse waveform cannot be illustrated, and the clock pulse generating zone is designated by a shaded portion.

FIG. 2(*d*) shows the output signal of the defect detector 5, FIG. 2(*e*) shows the output signal of the control circuit 4, FIG. 2(*f*) shows the waveform of the output signal of the switching circuit 6, and FIG. 2(*g*) shows the energizing current waveform of the ignition coil.

Assume that the clock pulse is normally outputted (in (I) section of FIG. 2), the control circuit 4 inputs the output signal of the waveform shaper 2 to calculate the energizing timing of the ignition coil, and outputs a signal illustrated in the (I) section of FIG. 2(*e*). The defect detector 5 judges that the output of the clock pulse of the oscillator is normal, and outputs an "L" signal as designated in (I) section of FIG. 2(*d*).

The switching circuit 6 is set to output, upon inputting of the "L" signal from the defect detector 5, an output signal of the control circuit 4 to the igniter 7, and to output, upon inputting of the "H" signal from the detector 5, an output signal of the waveform shaper 2.

Therefore, in this case, the igniter 7 inputs the output signal (in the (I) of FIG. 2(*f*)) of the control circuit 4, and intermittently interrupts the energization of the ignition coil as shown in FIG. 2(*g*).

When the clock pulse is not outputted from the oscillator (in the (II) section of FIG. 2), the control circuit 4 pauses the calculating operation of the energizing time, and stops to output the energizing timing signal as shown in the (II) section of FIG. 2(*e*).

However, the defect detector 5 detects that the clock pulse is not outputted from the oscillator, and outputs a signal of "H" level as shown in the (II) section of FIG. 2(*d*). Since the switching circuit 6 switches its output from the output signal of the control circuit 4 to the output signal of the waveform shaper 2, the igniter 7 intermittently energizes and interrupts the ignition coil as shown in FIG. 2(*g*) without interruption, and does not stop the rotation of the engine. The defect detector 5 also outputs a signal to the display circuit 8, and notifies the defect to the driver of the engine.

When the oscillator 3 is composed of a CR oscillator circuit, a defect detector 5 capable of readily detecting a defect with a relatively simple circuit can be achieved. FIG. 3 shows an example of the circuit diagram of an oscillator 3 and a defect detector 5 with the CR oscillator.

In FIG. 3, the oscillator 3 has a comparator 31, a capacitor 32 and resistors 33 to 36, and the defect detector 5 has comparators 51 and 52, and an OR gate 53.

In the oscillator 3, the non-inverting input terminal of the comparator 31 is connected to the connecting point of the resistors 33 and 34, which are connected in series between a power source Vcc and an earth.

The resistor 35 is connected between the non-inverting input terminal and the output of the comparator 31. The output terminal of the comparator 31 is connected to the control circuit 4 in FIG. 1.

The resistor 36 is connected between the inverting input terminal and the output terminal of the comparator 31, the inverting input terminal is connected through the capacitor 32 to the earth, and connected to the non-inverting input terminal of the comparator 51 and the inverting input terminal of the comparator 52 of the defect detector 5.

A reference voltage $V_{TH}$ 1 is applied to the inverting input terminal of the comparator 51, and a reference voltage $V_{TH}$ 2 is applied to the non-inverting input terminal of the comparator 52. The outputs of both the comparators 51 and 52 are applied through the OR gate 53 to the switching circuit 6 and the display circuit 8 in FIG. 1.

Figure 4:
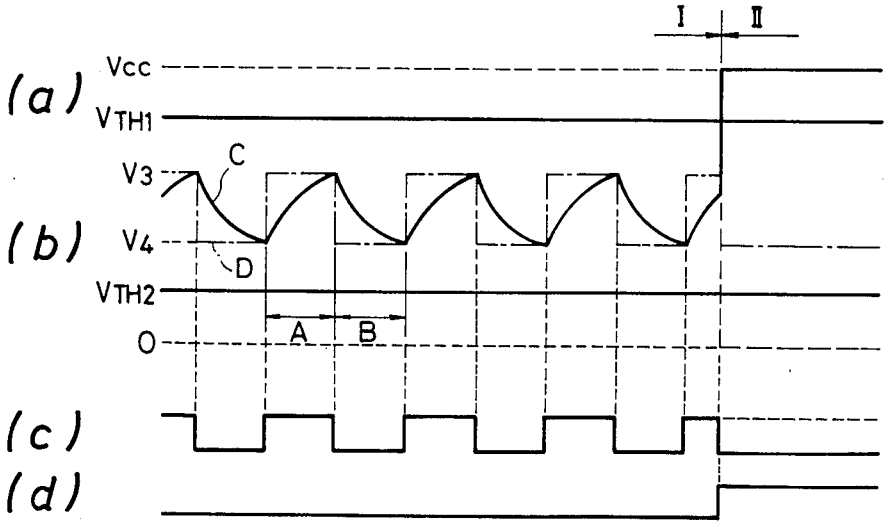

The operation of the circuit in FIG. 3 will be described with reference to the waveforms of the time chart in FIG. 4. FIG. 4(*a*) shows the voltage level of the power source Vcc, FIG. 4(*b*) shows the operations of the sections of the clock pulse from the oscillator 3, the waveform C of a solid line section of the waveform of the clock pulse illustrates the voltage waveform of the inverting input terminal of the comparator 31, and the waveform D of a dotted broken line section of the waveform of the clock pulse illustrates the voltage waveform of the non-inverting input terminal. FIGS. 4(*c*) and 4(*d*) show the clock pulse outputted from the oscillator 3 and the output signal of the defect detector 5, respectively similarly to FIG. 2.

The voltage of the non-inverting input of the comparator 31 becomes a voltage $V_3$ as divided by the resistors 33 and 34 and combined by the resistors 35 when the output of the comparator 31 is "H" in the zone (A) of FIG. 4(*b*), and the voltage of the inverting input rises, since the capacitor 32 is charged by the "H" output of the comparator 31 through the resistor 36 as illustrated by the solid line section C in the zone (A) of FIG. 4(*b*).

When the voltage of the inverting input of the comparator 31 reaches $V_3$, the output of the comparator 31 is switched from "H" to "L", the voltage of the non-inverting input becomes a voltage $V_4$ divided by the resistors 33 and 34 and combined by the resistor 35, and the voltage of the inverting input falls as designated by the solid line section C in the zone (B) of FIG. 4(*b*) since the capacitor 32 is discharged through the resistor 36.

When the voltage of the inverting input of the comparator 31 reaches the $V_4$, the output of the comparator 31 is switched from "L" to "H", and the above operation is repeated. Therefore, the clock pulse shown in the (I) section of FIG. 3(*c*) is outputted from the output of the comparator 31.

In the defect detector 5, the voltage of the inverting input of the comparator 31 is inputted to the comparators 51 and 52. A reference voltages $V_{TH}$ 1 is set to a predetermined value between the $V_3$ and the Vcc, and a reference voltage $V_{TH}$ 2 is set to a predetermined value between zero and the $V_4$.

Therefore, when the oscillator 3 oscillates as shown in the (I) section in FIG. 4, the voltage of the inverting input of the comparator 31 varies between the $V_3$ and the $V_4$, and does not exceed the reference voltage $V_{TH}$ 1 or $V_{TH}$ 2. Thus, the outputs of the comparators 51 and 52 become "L", and the output of the OR gate 53 becomes "L". As a result, the defect detector 5 judges that there is no defect.

When a defect such that the wirings of the capacitor 32 are opened occurs, the voltage of the inverting input of the comparator 31 exceeds the reference voltage $V_{TH}$ as shown by the solid line in the (II) section of FIG. 4 to become the voltage of the power source Vcc. Thus, the output of the comparator 51 is switched from "L" to "H", and the output of the OR gate 51 becomes "H". As a result, the defect detector 5 judges that there is a defect.

When a defect such that the wirings of the capacitor 32 are shorted at both terminals of the capacitor 32 occurs, the inverting input of the comparator 31 exceeds the reference voltage $V_{TH}$ 2 to become zero as designated by a broken line section in the (II) section of FIG. 4(*b*). Thus, the output of comparator 52 is switched from "L" to "H", and the output of the OR gate 53 becomes "H". As a consequence, the detector 5 judges that there is a defect.

As described above, the oscillator using the CR oscillator can judge a defect immediately when the charging or discharging voltage of the capacitor exhibits an abnormal value by monitoring the charging or discharging voltage of the capacitor, and the circuit arrangement can be simplified as has been described.

In the embodiments described above, the ignition timing signal generator 1 which outputs an alternating signal as shown in FIG. 2(*a*) has been employed. However, the present invention is not limited to the particular embodiment. For example, an ignition timing controller for determining the ignition period of an internal combustion engine by a microprocessor may be used as an ignition timing signal generator, and a rectangular wave signal outputted from the ignition timing controller may be sued as the rectangular wave in FIG. 2(*b*).

As described hereinbefore, according to the present invention, the engine is ignited according to the ignition timing signal synchronized with the rotation of the engine by judging a defect when the oscillator does not output a clock signal. Therefore, the defect of the oscillator of the ignition control system can be readily discovered when the oscillator becomes defective to prevent the engine from stopping rotating.

What is claimed is:

1. An ignition control system for an internal combustion engine comprising:

signal generating means for generating an ignition timing signal synchronized with the rotation of the engine;

an oscillator for generating a clock pulse;

control means for calculating the energizing time of an ignition coil upon reception of the clock pulse from said oscillator and the ignition timing signal from said signal generating means;

defect detector means for detecting the presence or absence of a defect of the clock pulse of said oscillator; and switching means controlled to be switched by the defect detector means for leading the output of said control means to an igniter when the clock pulse is normally outputted from said oscillator and leading the output of said signal generating means to the igniter when the clock pulse is abnormally outputted from said oscillator.

2. An ignition control system as claimed in claim 1, wherein said oscillator is composed of a CR oscillator, and said detect detector judges a defect of said oscillator when the charging or discharging voltage of the capacitor exceeds a predetermined value.

3. An ignition control system as claimed in claim 1, wherein when said defect detector judges a defect of said oscillator, a display circuit is automatically operated by the output of said defect detector.

4. An ignition control system as claimed in claim 1, wherein said oscillator includes a comparator having a non-inverting input terminal connected to a predetermined voltage and an inverting input terminal connected through a capacitor to an earth, and an output terminal connected to said control means for comparing the charged or discharged voltage of the capacitor with the predetermined voltage, a first resistor connected between the non-inverting input terminal of said comparator and the output terminal of said comparator, and a second resistor connected between the inverting input terminal of said comparator and the output terminal of said comparator.

5. An ignition control system as claimed in claim 4, wherein said defect detector includes a first comparator having a non-inverting input terminal connected to the inverting input terminal of the comparator of said oscillator and an inverting input terminal connected to a high reference voltage, and an output terminal connected through an OR gate to said switching circuit for comparing the charged or discharged voltage of the capacitor of said oscillator with the high reference voltage, a second comparator having a non-inverting input terminal connected to a low reference voltage and an inverting input terminal connected to the non-inverting input terminal of the comparator of said oscillator, and an output terminal connected through the OR gate to said switching circuit for comparing the charged or discharged voltage of the capacitor of said oscillator with the low reference voltage.

* * * * *